US008733011B2

(12) United States Patent
Spuhr

(10) Patent No.: US 8,733,011 B2
(45) Date of Patent: May 27, 2014

(54) SIGHT MOUNT WITH DIAGONALLY SPLIT RINGS AND ATTACHMENTS FOR ACCESSORIES

(75) Inventor: Håkan Spuhr, Dalby (SE)

(73) Assignee: Spuhr i Dalby AB, Bjärred (SE)

( * ) Notice: Subject to any disclaimer, the term of this patent is extended or adjusted under 35 U.S.C. 154(b) by 0 days.

(21) Appl. No.: 13/395,837

(22) PCT Filed: Sep. 13, 2010

(86) PCT No.: PCT/SE2010/000222

§ 371 (c)(1),
(2), (4) Date: Mar. 22, 2012

(87) PCT Pub. No.: WO2011/031204

PCT Pub. Date: Mar. 17, 2011

(65) Prior Publication Data

US 2012/0174462 A1 Jul. 12, 2012

(30) Foreign Application Priority Data

Sep. 14, 2009 (SE) ..... 0901180

(51) Int. Cl.
*F41G 1/387* (2006.01)

(52) U.S. Cl.
USPC ..... 42/124

(58) Field of Classification Search
USPC ..... 42/124, 125, 126, 127, 128; D22/110
See application file for complete search history.

(56) References Cited

U.S. PATENT DOCUMENTS

| | | | | |
|---|---|---|---|---|
| 2,202,000 | A | 5/1940 | Gray | |
| 2,774,142 | A | 12/1956 | Lake et al. | |
| 2,775,817 | A | 1/1957 | Schuman | |
| 2,782,509 | A * | 2/1957 | Ivy | 42/126 |
| 2,782,511 | A * | 2/1957 | Ivy | 42/126 |
| 2,911,723 | A | 11/1959 | Ashbrook | |
| 3,424,420 | A | 1/1969 | Seiderman | |
| 3,559,940 | A * | 2/1971 | Kruzell | 42/127 |
| 4,561,204 | A | 12/1985 | Binion | |
| 4,756,111 | A * | 7/1988 | Lapier | 42/128 |
| 5,033,219 | A | 7/1991 | Johnson et al. | |
| 5,406,733 | A | 4/1995 | Tarlton et al. | |
| 2007/0199225 | A1 | 8/2007 | Haugen | |
| 2008/0022576 | A1 * | 1/2008 | Epling | 42/124 |

* cited by examiner

*Primary Examiner* — Bret Hayes
(74) *Attorney, Agent, or Firm* — Capitol City TechLaw

(57) ABSTRACT

A sight mount for firearms, consisting of a base plate (101), arranged to be fitted onto a firearm. The sight mount is fitted with integrated and split rings and two top ring halves (106, 124) are arranged to attach a riflescope. The sight ring (104, 111) is diagonally split (103) and has planar sides in the vertical and horizontal planes as to make visible the visible the adjustment knobs of the riflescope when in a firing position and to visualize parallel reference lines in the environment, thus providing a sub-conscious perception of the weapons vertical alignment.

12 Claims, 4 Drawing Sheets

SIGHT MOUNT WITH DIAGONALLY SPLIT RINGS AND ATTACHMENTS FOR ACCESSORIES

TECHNICAL FIELD

The present invention relates to a sight mount for firearms and more specifically to sight mount for firearms with optically magnified sights.

TECHNICAL BACKGROUND

Use of a firearm at varying distances necessitates that the shooter has knowledge and experience. To increase the shooter's performance at greater distances and in varying light conditions, optically magnified sights (henceforth referred to as "riflescope") are used. Many riflescopes allows for the shooter to determine the range to a target via the reticle, and to adjust the point of aim with great accuracy to coincide with the point of impact; such adjustments are done in the vertical and horizontal planes through the use of adjustment knobs on top and on one or both sides of the riflescopes body (usually the right side).

To attach a riflescopes to firearms various mounting solutions called mounts or bases, and mounting devices called rings are used. In U.S. Pat. No. 2,775,817 (FIG. 4) an example of the most commonly used type of rings may be found, which are split in the horizontal plane such that the riflescope can be simply laid in place into the lower halves of the rings after which the top halves can be screwed in place against the lower halves. The problem with this solution is that the attachments between the two halves require that the rings are wide enough around the attachment areas for the threads and screws without affecting the strength of the ring. The result is that the rings obscure the riflescopes horizontal adjustment knobs, requiring the shooter to adjust his body position in order to verify or adjust the settings of the riflescope.

In U.S. Pat. No. 2,202,000 we find another common embodiment where the rings are split along the vertical plane. The problem with this solution is that the rings block the riflescopes vertical adjustment instead, resulting in the same problem as with U.S. Pat. No. 2,775,817 (FIG. 4).

In U.S. Pat. No. 3,424,420 we find a solution where a thin arcuate sheet metal saddle member is clamped against the bottom clamp members, thus replacing the upper half of the ring. The problem with this solution is that it is difficult to ensure that the riflescope retains its alignment and is not tilted to the side. In U.S. Pat. No. 2,911,723 we find a solution that is reminiscent of U.S. Pat. No. 3,424,420, but where the arcuate saddle is clamped around the tube of the riflescope and then attached to the lower half. It is known that this solution often results in surface damage to the riflescope; it also suffers from the same problem as U.S. Pat. No. 3,424,420.

Today it is very common that military and police marksmen attach optical accessories and laser marking units to their firearms as a supplement to their standard riflescope, as to provide target identification for other assisting personnel. In U.S. 2007/0199225 A1 such a sight mount is disclosed, which protrudes forward over the firearm's barrel as to allow the mounting of equipment in front of and to the sides of the ordinary riflescope. The problem with this solution is that it increases the weight of the firearm; it also raises the riflescope's position above the firearm, which requires an adjustable cheek rest as well as raising the firearms centre of gravity. Another manufacture is the McCann Industries MIRS Mount.

Another solution is to replace the top halves of rings for halves with integrated mounting solutions for accessories. Examples of such products are the LaRue STOMP and Atlantic Research Marketing Systems #22 TRC, however these solutions amplify the problem related to obscuration of the adjustment knobs of the riflescope.

It is also very common today that a shooter wants a secondary back-up sight for use at shorter ranges or in case of the primary sight getting damaged. A common position for a back-up sight is at a 45-degree angle from the standard sight, so that if the shooter wants to use the back-up sight he only has to tilt the top of the fire-arm inwards towards himself.

To ensure that any calculations or adjustments are correct, the riflescope must be mounted so that the vertical plane of adjustment coincides and is aligned with the centre-line of the firearm's bore. If the vertical adjustment is aligned with the centre-line of the bore then the horizontal adjustments will be perpendicular to the centre-line of the bore.

There are several existing technical solutions as to ensure that a firearm is held level without tilting it to the sides; in U.S. Pat. No. 5,406,733 we find a variant of a spirit level which is mounted onto a riflescope and there are several variations of this design, as well as spirit levels that are mounted onto the existing sight mount.

SUMMARY

It is a purpose of the present invention in accordance with several embodiments thereof to provide a sight mount with integrated rings for firearms, which provides a clear view of the riflescope's adjustment without the need for the shooter to change his body position; which allows the mounting of accessories without the need of replacing parts of the embodiment; which allows the mounting of accessories in a 45-degree angle from the primary optical sight; and which through its design allows that the side-to-side tilt can be verified via a quick visual reference to the surrounding.

In a preferred embodiment the rings of the sight mount is split in a diagonal plane from 315 degrees to 135 degrees. This split prevents any of the attachment points between the two ring halves from obscuring the riflescope's adjustment knobs as common on other rings.

In the preferred embodiment the two top ring halves have accessory attachment points in the form of a countersunk slot between two screw holes. When the top ring halves are mounted against the integrated rings of the mount—with two or more screws per ring—these accessory attachment points allow the mounting of accessories at the 45-degree position relative to the centreline of the riflescope.

The angled sides of the top ring halves are fitted with parallel grooves which allows for quick and correct control of the riflescope's adjustments.

In a preferred embodiment the lower front ring half is fitted with an accessory attachment point on its left side. This accessory attachment point is of the same design as that of the top ring halves and it is situated in such a way that it is parallel to the bore of the rifle.

In a preferred embodiment the left side of base plate of the sight mount is provided with two accessory attachment points. These accessory attachment points are of the same design as those of the top ring halves and on the front ring and are arranged in such a way that they are parallel to the bore of the rifle.

In a preferred embodiment a back portion of the base plate of the sight mount is provided with an integrated spirit level so that the shooter can verify that the firearm is being held level and does not tilt to the side.

In the preferred embodiment the sides of the rings are squared so that a shooter easily can find a parallel reference line in his surrounding and thereby confirm that the firearm is being held level even if the integrated spirit level has been damaged.

BRIEF DESCRIPTION OF THE DRAWINGS

The invention will now be described in greater detail with reference to the attached drawings, in which:

FIGS. 3A-3E illustrate in multi-view orthographic projection an embodiment of a sight mount for firearms with a riflescope.

DETAILED DESCRIPTION

FIGS. 1A-1D illustrate an embodiment 100 of a sight mount for firearms with riflescopes, with a riflescope attached. The sight mount 100 is in the illustrated embodiment fitted with clamping screws as to be attached to an accessory mounting rail conforming to MIL-STD-1913/STANAG 2324.

Figure 1A:
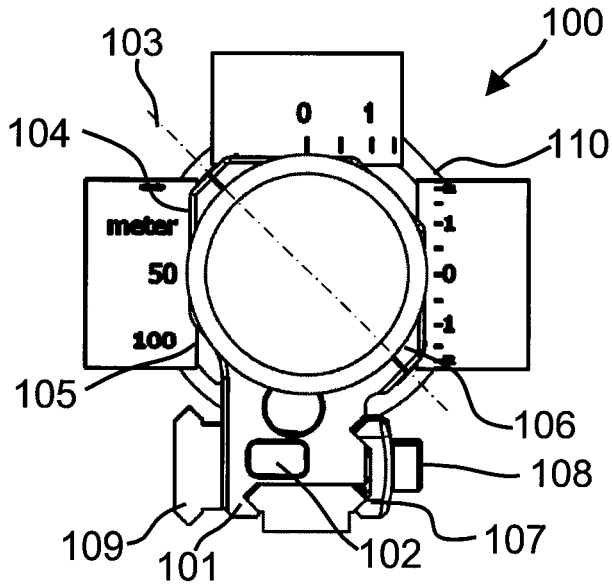
FIGS. 1A-1D illustrate in various angles from the rear and from the left an embodiment of a sight mount for firearms with a riflescope.

Referring to FIG. 1A the sight mount 100, including a base plate 101 with an integrated spirit level 102 is shown in a view from the back—in an imagined direction of fire when a riflescope is installed in the mount and the mount is attached onto a firearm's accessory mounting rail. A rear mounting ring 104 is divided by a diagonal split 103 and has a vertical side 105 and a rear ring half 106. The sight mount 100 also includes a clamp rail 107 and a first clamping screw 108. All three adjustment knobs of the riflescope can be clearly read from this position without any part of the sight mount or the rear ring obscuring the riflescope.

The embodiment in FIG. 1A has a first accessory attachment rail 109 mounted onto forward left side of the base plate 101 for the attachment of a first accessory, and a second accessory attachment rail 110 in a 45-degree angle on the forward ring half (not shown in the prestent view) for the attachment of a second accessory or a secondary back-up sight. The secondary back-up sight can be, but is not limited to, a mechanical iron sight, a red dot sight, a laser sight or an optical sight.

The attachment rails 109 and 110 can either be fixed or removable mounting adapters or rails for specific accessories and/or sights. The first and second accessory/sight can be of the same or different types.

Figure 1B:
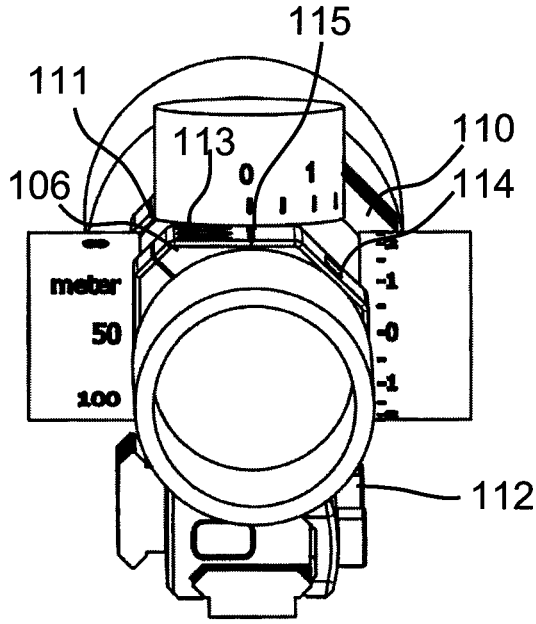

FIG. 1B is a view from the rear and above of the sight mount illustrating an integrated front ring 111, a second clamping screw 112, additional screw holes 113 and countersunk attachment slot 114 for an accessory rail, and the upper indexing groove 115.

Figure 1C:
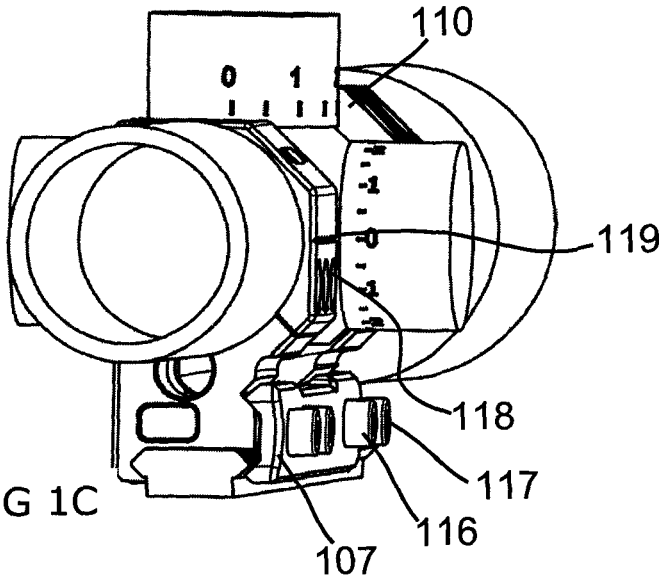

FIG. 1C is a view from the rear right and above of the sight mount where a third and forth clamping screw 116 and 117, and additional screw holes 118, and lower indexing groove 119 are visible. The dial of the right adjustment means may easily be read with the aid of the lower indexing groove.

Figure 1D:
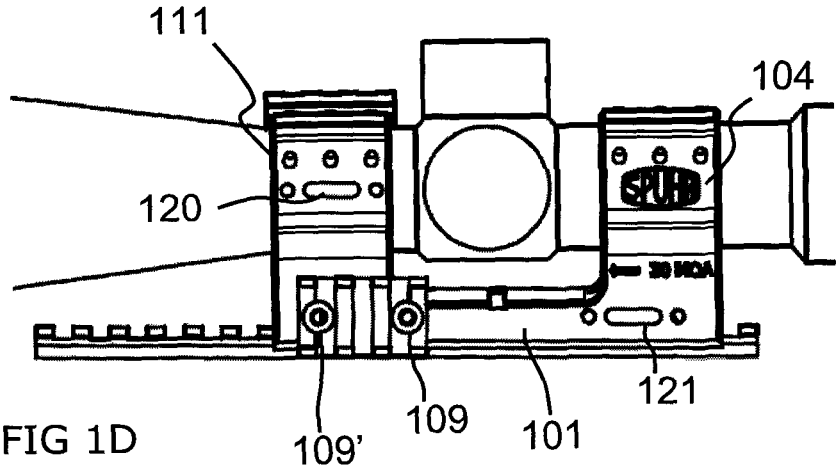

FIG. 1D is a view from the left of the sight mount with the forward lower accessory attachment rail 109 and attachment screw 109', forward upper 120 and rear attachment point 121.

Figure 2A:
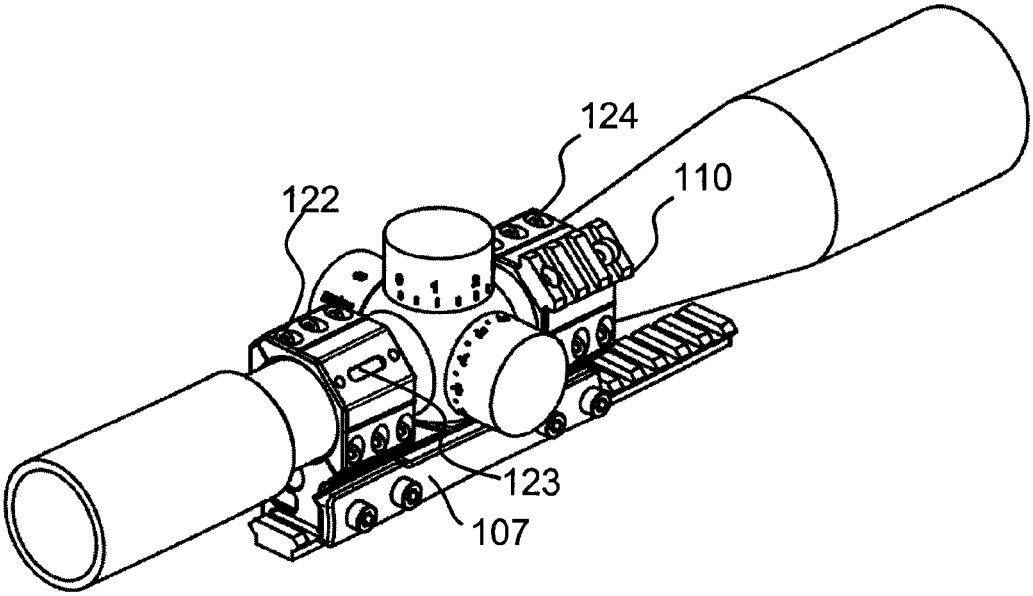
FIGS. 2A-2B illustrate in an oblique angle from above and from the right and the left an embodiment of a sight mount for firearms with a riflescope.

FIG. 2A is a view from above and to the rear right of the sight mount. In this view it is apparent how the ring halves attach to the rings with multiple screws 122, how an attachment slot 123 for the attachment rail is arranged and how the attachment rail 110 is attached to the attachment slot (not shown) on the front top ring half 124. It is also apparent from this view that the two top ring halves are identical and may be exchanged as well as reversed backwards and forwards without affecting their function.

Figure 2B:
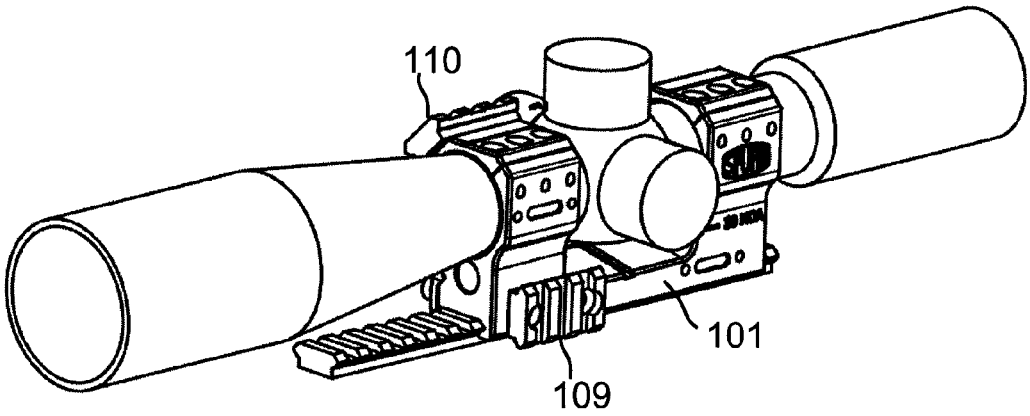

FIG. 2B is a view from above and the front left of the sight mount where it is shown how an accessory attachment rail attached to the forward lower attachment point relates to the rest of the sight mount.

Figure 3E:
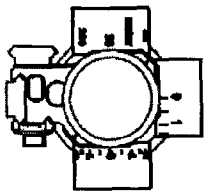
Figure 3A:
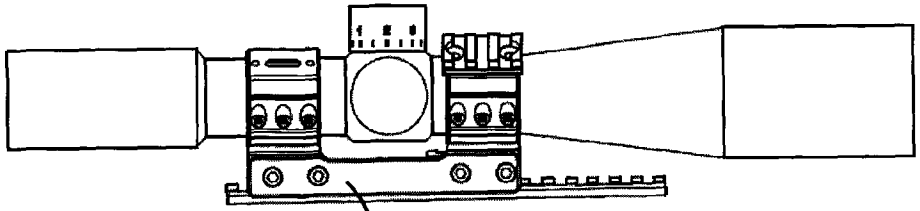

FIG. 3A is a view from the right.

FIG. 3B is a view from the from above.

Figure 3C:
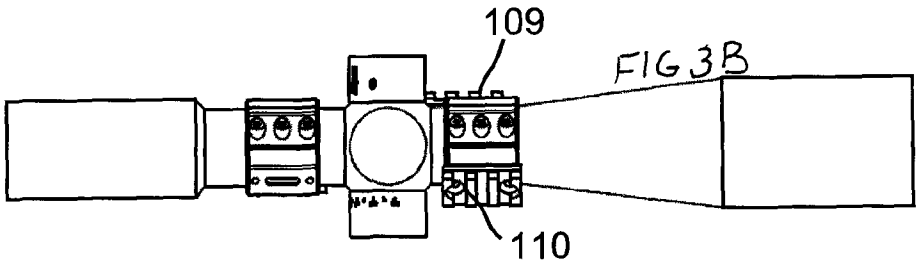
Figure 3C:
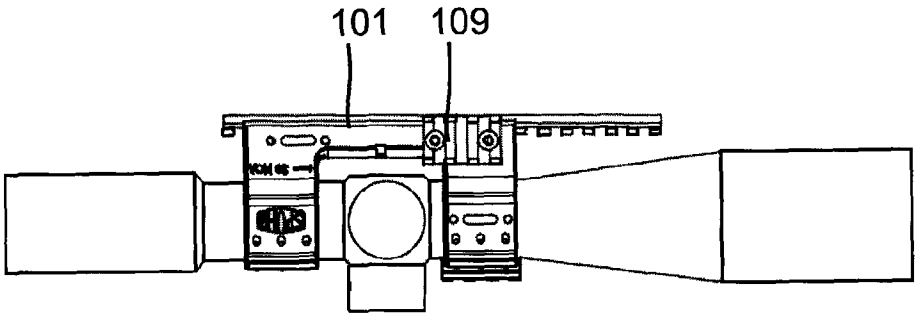

FIG. 3C is a view from the left.

Figure 3D:
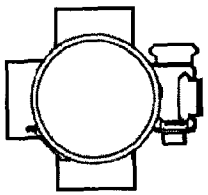

FIG. 3D is a view from the front—reversed to a the line if fire.

FIG. 3E is a view from the rear—along the line of fire.

The invention claimed is:

1. A sight mount for firearms, the sight mount comprising:
- a base plate to be mounted onto a firearm; and
- a pair of integrated and divided sight rings extending from the base plate, each sight ring including a ring half;
- wherein each sight ring is diagonally split and has planar and squared sides arranged in respective planes that are perpendicular to each other; and
- a riflescope including adjustment knobs on top and one or both sides of the riflescope
- wherein the riflescope is mounted in the sight rings, such that the adjustment knobs are visible in a view in a direction of fire, and such that parallel reference lines to the squared sides are identifiable in an environment.

2. The sight mount of claim 1, wherein the ring halves are arranged to carry one or more accessory attachment rails or other accessories via attachment points.

3. The sight mount of claim 1, where each of the base plate and a front one of the sight rings is provided with one or more attachment points.

4. The sight mount of claim 1, wherein each of the sight rings is provided with integrated attachment points for accessories on the side of the sight ring.

5. The sight mount of claim 1, wherein each ring half is provided with integrated attachment points for accessories in angles from 15 to 75 degrees from the center of the sight ring.

6. The sight mount of claim 1, further comprising integrated attachment points on a side of the sight mount.

7. A sight mount for firearms, the sight mount comprising:
- a base plate to be mounted on a firearm; and
- a pair of sight rings mounted on the base plate;
- wherein each of the sight rings has
  - a removable ring half for attachment of a riflescope,
  - a top planar surface lying in a first reference plane,
  - a right side planar surface lying in a second reference plane that is perpendicular to the first reference plane, and
  - a left side planar surface lying in a third reference plane that is perpendicular to the first reference plane; and
- wherein each of the sight rings is split along a parting interface that lies in a diagonal reference plane that intersects the first, the second and the third reference planes.

8. The sight mount of claim 7, wherein the ring halves are arranged to carry one or more accessory attachment rails or other accessories via attachment points.

9. The sight mount of claim 7, where each of the base plate and a front one of the sight rings is provided with one or more attachment points.

10. The sight mount of claim 7, wherein each of the sight rings is provided with integrated attachment points for accessories on the side of the sight ring.

11. The sight mount of claim 7, wherein each ring half is provided with integrated attachment points for accessories in angles from 15 to 75 degrees from the center of the sight ring.

12. The sight mount of claim 7, further comprising integrated attachment points on a side of the sight mount.

* * * * *